US005394620A

United States Patent [19]

Chimera

[11] Patent Number: 5,394,620

[45] Date of Patent: Mar. 7, 1995

[54] BODY DRYER

[76] Inventor: Carmen R. Chimera, 14213 Woodcrest Dr., Rockville, Md. 20853

[21] Appl. No.: 230,556

[22] Filed: Apr. 20, 1994

[51] Int. Cl.[6] ..... A45D 20/00

[52] U.S. Cl. ..... 34/97; 392/380; 392/384; 34/98

[58] Field of Search ..... 34/96–101, 34/283; 392/379, 380, 382, 383, 384, 385, 373

[56] References Cited

U.S. PATENT DOCUMENTS

| | | | |
|---|---|---|---|
| 2,753,434 | 7/1956 | Storm | 34/97 |
| 3,835,869 | 9/1974 | Newman et al. | 132/9 |
| 3,981,314 | 9/1976 | Barradas | 132/9 |
| 4,594,797 | 6/1986 | Houck, Jr. | 34/225 |
| 4,711,988 | 12/1987 | Thaler et al. | 34/97 |
| 4,757,183 | 7/1988 | Karey et al. | 34/97 |
| 4,827,105 | 5/1989 | Brown | 34/97 |
| 5,195,253 | 3/1993 | Poumey et al. | 34/97 |

*Primary Examiner*—Denise L. Gromada

[57] ABSTRACT

A hand held, portable body dryer for the entire body is disclosed as including a hollow tube carrying a hollow hand grip in which a battery is disposed; a fan and a heater are disposed in the tube with rheostatic controls therefor on the exterior of the tube with indications for off, low and high positions, and with a reverse fan switch for cleaning the tube. A plurality of attachments for the dryer function as outlet nozzles for assuring entire body coverage.

7 Claims, 1 Drawing Sheet

BODY DRYER

The present invention relates to a body dryer and, more particularly, to a portable, electric hand held body dryer for drying the entire body.

BACKGROUND OF THE INVENTION

Air dryers are well known in the art which is exemplified by U.S. Pat. Nos. 5,007,182 and 4,827,105. The body dryer shown in U.S. Pat. No. 5,007,182 relates to a body dryer which has many disadvantages including: (1) an allegation of being portable but as shown in FIG. 1 requires a person to stand on a platform and thus is not a hand held portable dryer, so it cannot be hand held during operation; (2) the upper portion of the body does not receive the hot air directly but only after travelling upward causing a reduction of the heat in air as it flows upward; and (3) the overall design of this dryer is primarily directed toward the drying of the feet.

U.S. Pat. No. 4,827,105 is directed to a portable, electric, hand held hair dryer for drying the hair and not the entire body.

SUMMARY OF THE INVENTION

The Applicant's body dryer is a small, lightweight, handheld blow-dryer that has two variable controls for adjusting heat and air-flow independently of one another. By adjusting these controls, the user is able to select the most pleasing combination of heat and airflow to use in a manner which will enable the user to totally dry themselves. Let there be no mistake with regard to the phrase totally dry. When one has taken a bath or showered and then towels themselves dry, as everyone knows, the body is still very wet! There is general wetness in all the hairy areas of the body, and particularly between the toes and in the small of the back. These areas are simply too difficult to reach and rub dry. The fact is that as one continues to use the towel it obviously gets wetter itself, thus losing capability to dry the body better. Therefore, it should be acknowledged that the body does in fact remain wet even after a person has attempted to dry themself as thoroughly as possible. Consequently, it should also be noted that a need exists to find a method that will enable a person to really and truly get their body dry!

Why is total dryness a need? Because as we all know, warm damp skin is a breeding ground for germs and infection. Fungus growth is promoted by such conditions. Our skin is a vital organ that is meant to provide us all with protection. We must in turn, try to protect our skin as well as we can. Therefore, total dryness is not only a need, it is a necessity. Who is it a necessity for? For everyone—adults, children, and especially, babies. To break it down further, those people who are bed-ridden and must be administered to, such as: hospital patients; the physically handicapped will also find Applicant's dryer extremely useful.

In addition to necessity, total body dryness is also a pleasureable feeling. Consider how it feels after bathing during the hot humid summer. Even with air conditioning, toweling dry is an effort in futility. One simply sweats until eventually the body heat finally finds a balance with the room temperature and humidity. But, there are fewer more unpleasant feelings than to continue to sweat while trying to administer various body lotions, make-up, and other toiletries while dressing. Recall the totally unpleasant feeling one has when trying to pull on one's clothes while still wet with body sweat after bathing in the summer. The same applies during any season if one has just experienced a physical workout followed by a shower. The body is still seeking an equilibrium of temperature and inner humidity. The only way to beat such heat is with Applicant's dryer. Using a blow-dryer at a low body temperature and high air flow brings the body heat down to equilibrium. The sweating is brought under control within a comfortable 5–10 minutes of very stimulating and pleasurable drying with Applicant's body dryer.

The use of certain attachments facilitates the application of the air stream over all the various parts of the body. There is a brush attachment that helps to directly remove excess moisture while at the same time delivering a pleasant stimulation to the skin while drawing it back and forth across the body. The air stream dries all the while this process is administered. Other attachments provide either more focused air streams or more difused air streams, chosen to give what provides the better feeling to each person as they feel best suits them.

In similar fashion, a warm and comfortable feeling is attained during the colder winter season when one bathes. The general feeling during this time of year is a chill and coldness while the body is still wet, (towel dry). Thus, when using Applicant's dryer now, it imparts a very warm, dry, and comfortable feeling as one takes 5–10 minutes of a very refreshing period of blow drying. Again, the attachments are chosen to suit individual taste and pleasure. When one considers that for 5–10 minutes every time a bath or shower is taken, the individual has a total pleasureable and relaxed experience, then the true value of using Applicant's dryer is realized. It is a moment of true peace of mind and relief from stress that adds quality to one's own life.

While high tech advances have made diapering babies a much more hygienically appropriate choice, the use of baby wipes or moist, disposable towels leaves baby's very tender skin both wet and cold. As we all know, babies frequently get skin irritation and rashes. The use of Applicant's dryer will completely replace wetness and cold with dryness and warmth. Furthermore, while mother or father is gently massaging baby's skin while also blowing baby's skin with a gentle, warm air flow, there is an obvious bonding opportunity. The gentleness and pleasure of dry warmth being administered by a loving parent should create only the best of feelings for baby and parent.

Consider all the hygiene benefits of the total dry condition. Body problems resulting from fungus infections will be eliminated. This will result in the individual no longer relying upon the use of fungicides to combat such skin problems. For all people suffering from atheletes foot infections, this will bring blessed relief from agony. Various skin irritations and rashes that occur will also benefit from the total dry condition. Under arm irritation or crotch irritation, or anal itch will all be benefited.

The facility of Applicant's dryer is enhanced by virtue of the fact that it is battery operated. The salient fact of this feature is total ease of use compared to the conventional hair dryer so commonplace in people's lives today. The hair dryer with its electrical cord fixed in an electrical outlet obviously limits both movement and motion as one trys to twist and turn to aim the air stream over different parts of the body. Whereas, Applicant's dryer has no restriction at all. Thus not only can one twist and turn to reach all body areas with ease, the individual can also go into any room to finish this activity even though no electrical outlet may be nearby. This is an important feature for allowing baby to be taken care of while away from home in any environment. The feature of battery operation is unique in giving the necessary freedom of motion, movement, and location to fully take advantage of all the benefits of the dryer.

Another unique feature is the CLEAN switch position. This causes the blower to run in a reverse flow. What this achieves is the removal of the collection of lint from the screen guard on the intake nozzle of the dryer. The importance of keeping the screen clear of lint is the volume of air flow is maintained at it's maximal potential.

Another benefit of the battery operation feature is the personal safety fact of using an electrical appliance around water since one is usually in the bathroom when using the dryer. Thus the electrical circuit breaker assembly now required of hair dryers for safety reasons is not required for this dryer.

And still another safety feature is the connection between the heat control and the air flow control. If the air flow control is below a minimum setting, the heat control remains disabled. This will prevent overheating in the body of the dryer.

DETAILED DESCRIPTION

Figure 1:
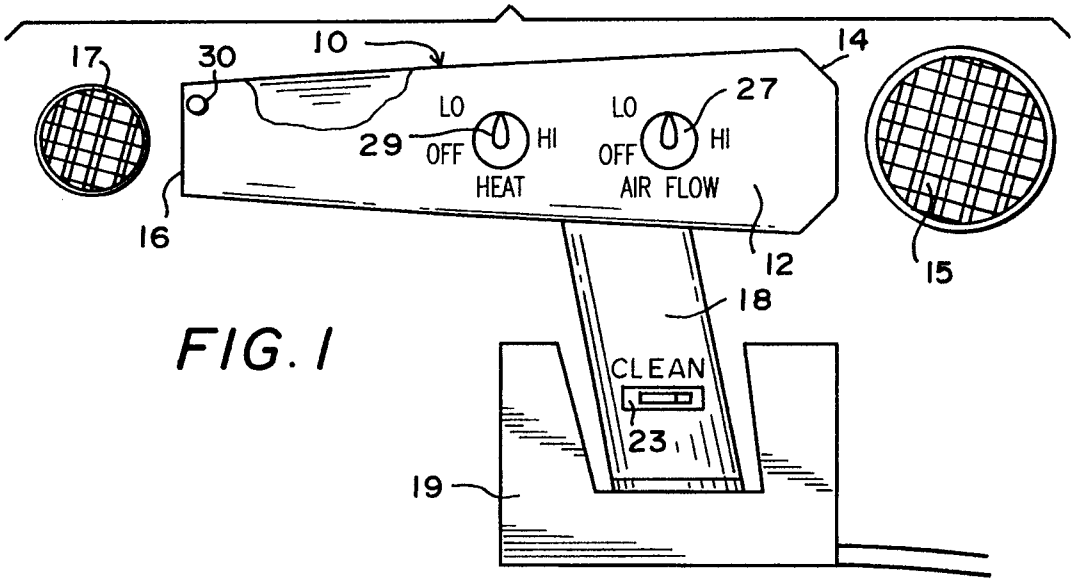
FIG. 1 is a schematic side view of a body dryer embodying the present invention.

As is illustrated in FIG. 1, the present invention is embodied in a body dryer, indicated generally at 10, which includes a generally hollow tube 12 having an air inlet 14 with a filter screen 15 and an air outlet 16 with a filter screen 17. A generally hollow hand grip 18 extends transversely from and is connected to the tube 12. A conventional battery 20 is disposed in the hand grip 18 and is electrically connected to a fan motor 22 and a heat coil 24. Air flow control 26 and air heat control 28 (FIG. 7) are operatively disposed in the tube 12 and are responsive to manually operated rheostatic indicators 27 and 29, respectively, carried on the outside of the tube 12 (FIG. 1). The heat indicator 29 has three indicating positions, OFF, LOW and HIGH. The air flow indicator also has three indicating positions, OFF, LOW and HIGH. A slide button 23 for the clean switch 34 is located on the hand grip 18 and results in the reversal of fan motor 22 to cause the removal of the collection of lint from the screen guard 15 on air inlet 14 of the tube 12. A conventional recharging device 19 may be used for recharging the battery when needed.

It should be noted that the rheostatic control indicators 27 and 29 are not stepped or digital type of controls, but rather they are continuous or analog type of controls. For example, the air flow indicating 27 may be set at any position between the OFF position and the HIGH position. The heat indicator 29 also may be set at any position between the OFF position and the HIGH position.

Adjacent the outlet 16, the hollow tube 12 is provided with an exterior support element 30 which is located to interlock with a holder 31 in a manner similar to a bayonet joint. The holder 31 is mounted on an elbow-shaped, hollow nozzle-type attachment 32 which carries a brush 33 on its outlet. A rotatable joint adjacent the inlet of the nozzle 32 permits the nozzle 32 and the brush 33 to move in circular motions across the body parts.

Figure 3:
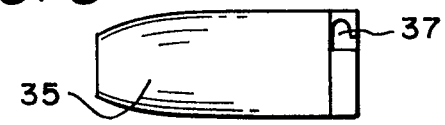
FIG. 3 is a side view of a constricting nozzle attachment for the dryer of FIG. 1.

A second hollow nozzle-type attachment 35 is shown in FIG. 3 as having a constricting outlet and a holder 37 adjacent its inlet. The holder 37 interlocks with the support element 30 in the same manner described above for the holder 31.

Figure 4:
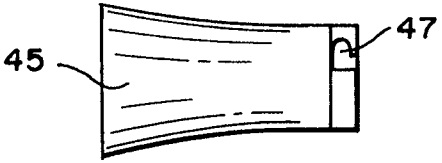
FIG. 4 is a side view of a diffusing nozzle attachment for the dryer of FIG. 1.

A third hollow nozzle-type attachment 45 is shown in FIG. 4 as having a diffusing outlet and a holder 47 adjacent the inlet. The holder 47 interlocks with a support element such as shown at 30 in FIG. 1.

Figure 5:
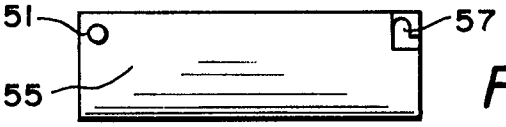
FIG. 5 is a side view of a tube attachment for the dryer of FIG. 1.

A fourth hollow nozzle-type attachment 55 is shown in FIG. 5 as having a holder 57 adjacent the inlet. The holder 57 interlocks with a support element such as 30 in FIG. 1. The attachment 55 is a hollow tubular extension for supporting an additional nozzle attachment by means of a holder 51 on the outlet end of the hollow tubular extension 55.

Figure 6:
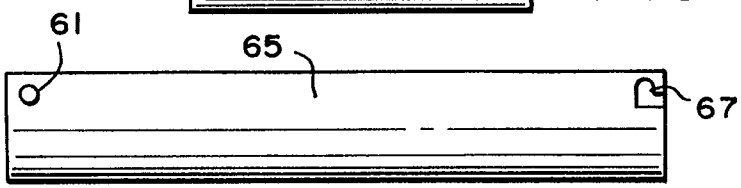
FIG. 6 is a side view of a longer tube attachment for the dryer of FIG. 1.

A fifth hollow nozzle-type attachment 65 is shown in FIG. 6 as having a holder 67 adjacent the inlet. The holder 61 interlocks with a support element such as 30 in FIG. 1. The attachment 65 is an elongated hollow tubular extension for supporting an additional nozzle attachment by means of a holder 61 on the outlet end of the hollow tubular extension.

The above described different type of nozzles may be used separately or in different combinations of such nozzles. This facilitates the use of the dryer over the entire body of an adult as well as a child.

The body dryer is operated by selecting one or more nozzle attachments which are interlocked together and to the hollow tube. The hand grip is placed in the operator's hand and the thumb is utilized for adjustment to the desired rheostatic setting. While the body dryer is operating and being moved over the body, the thumb may also be used to operate the rheostatic element 27 for changing air flow and the rheostatic element 29 for changing heat settings. During the changes of the rheostatic elements, the fan motor 22 and the heat coil 24 continue to operate so there is no interruption of the drying of a body.

To commence operation of the body dryer, the rheostatic controls 27 and 29 are set at desired positions; a selected attachment, the constricting nozzle 35 for reaching the lower body or the diffusing nozzle 45 for the upper body and head is interlocked with the tube outlet 16 by the bayonet joint connector 37 or 47 with the holder 30. When drying the feet, the elongated extension nozzle 65 is attached to the blower tube 12 by the interlocking members 67 and 30. Any of the other attachments may be interlocked with the extension nozzle attachment 65 by means of the support element 61.

Figure 7:
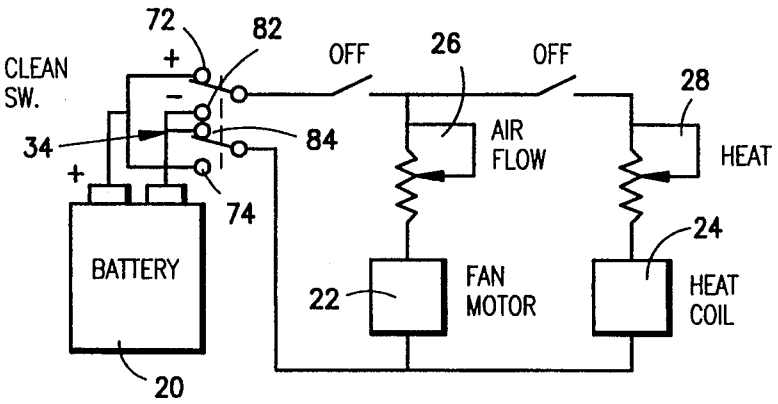
FIG. 7 is a circuit diagram for the electrically operated dryer of FIG. 1.
Figure 2:
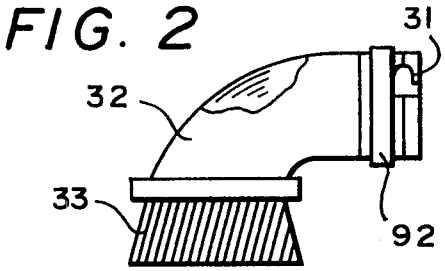
FIG. 2 is a side view of a brush attachment for the dryer of FIG. 1.

The electric switching circuitry shown in FIG. 7 prevents the heater 24 from operating unless the fan 22 is also operating. The two rheostatic controls are operable only when the fan and heater settings are not in the OFF positions. This is a safety feature preventing excessive heat in the tube 14.

The switching circuitry also includes a double pole double throw switch 34 between the battery 20 and the leads to the fan 22 and heater 24. The switch 24 has two spaced contacts 72 and 74 electrically connected to the positive terminal of the battery 20, and two other spaced contacts electrically connected to the negative terminal of the battery 20. A first, upper switch arm is positioned for movement between the contacts 72 and 82 while a second, lower switch arm is positioned for movement between the contacts 74 and 84. When it is desired to clean the tube 14, the heater rheostatic control 29 is moved to its OFF position and the fan rheostatic control 27 is moved to the HIGH position; the clean switch operator 23 is then moved from an OFF position to an ON position, causing simultaneous movement of the upper and lower switch arms whereby the upper switch arm moves from the positive contact 72 to the negative contact 82, and the lower switch arm moves from the negative contact 84 to the positive contact 74.

When it is desired to clean the tube 12, the heat indicator 29 is moved to the OFF position and the slide button 23 is moved to its operating position wherein the clean switch 34 is actuated. As is shown in FIG. 7, the clean switch 34 is a double pole double throw switch; upon actuation by the slide actuator button, the switch 34 is actuated causing the upper and lower switch arms to move to adjacent contacts and thus reverse polarity.

Inasmuch as the present invention is subject to many modifications, variations and changes in details, it is intended all matter described above or shown on the accompanying drawing, shall be interpreted as illustrative and not in a limiting sense.

I claim:

1. A hand held, portable body dryer comprising:

a generally hollow tube having an air inlet and an air outlet;

fan and heating means in said tube;

a support element carried by said tube adjacent said outlet;

an arrangement of a plurality of selective attachments;

each attachment having a holder at one end to interlock with said support element on said tube;

a generally hollow hand grip connected to said tube and extending generally transverse thereto;

battery means in said hand grip for energizing said fan and heating means;

switching means electrically connecting said battery means to said fan and heating means;

manual operating means mounted on said tube and controlling a plurality of switch positions from off to high operating conditions of said fan and heating means; and a clean control position for said fan means defining a reverse position for reversing air flow through said tube.

2. A hand held, portable body dryer comprising:

a generally hollow tube having an air inlet and an air outlet;

a hollow hand grip connected to said tube and extending generally transverse thereto;

an electrically operated fan in said tube;

an electrically operated heater in said tube;

battery means in said hand grip electrically connected to said fan and said heater;

manually operated control means on said tube controlling a plurality of control positions from off to high operating conditions of said fan and of said heater;

a separate control position for said fan including a reverse position whereby air flow through the tube is reversed to effect a cleaning of lint from the tube;

a support element carried by said tube adjacent said air outlet; and a plurality of selective attachment means each having a holder at one end to interlock with said support element on said tube.

3. A hand held, portable body dryer as claimed in claim 2 wherein a first selected attachment includes a hollow elbow-shaped tubular member with a brush on an end opposite said holder.

4. A hand held, portable body dryer as claimed in claim 2 wherein a second selected attachment includes a hollow tubular member with a constricting nozzle on an end opposite said holder.

5. A hand held, portable body dryer as claimed in claim 2 wherein a third selected attachment includes a hollow tubular member with a diffusing nozzle on an end opposite said holder.

6. A hand held, portable body dryer as claimed in claim 2 wherein a fourth selected attachment includes a hollow tubular member having a support element on an end opposite said holder whereby said fourth selective attachment defines an extension for supporting an additional attachment to reach remote parts of the body to be dried.

7. A hand held, portable body dryer as claimed in claim 2 wherein a fifth selected attachment includes an elongated hollow tubular member having a support element on an end opposite said holder whereby said fifth additional attachment defines an elongated extension for supporting an additional attachment to reach remote parts of the body.

* * * * *